US005364264A

United States Patent [19]

Kwiatek

[11] Patent Number: 5,364,264

[45] Date of Patent: Nov. 15, 1994

[54] ELECTRODE ASSEMBLY FOR GAS BURNER SPARK IGNITION

[75] Inventor: David J. Kwiatek, LaGrange, Ill.

[73] Assignee: Harper-Wyman Company, Aurora, Ill.

[21] Appl. No.: 152,843

[22] Filed: Nov. 15, 1993

[51] Int. Cl.[5] ..... F23Q 3/00

[52] U.S. Cl. ..... 431/266; 431/264; 126/39 E

[58] Field of Search ..... 126/39 E, 39 R, 39 AB; 431/258-266; 239/552, 567, 568

[56] References Cited

U.S. PATENT DOCUMENTS

| | | | |
|---|---|---|---|
| 546,923 | 9/1995 | Groebbels | 431/266 |
| 1,931,083 | 10/1933 | Rodler | 431/266 |
| 1,968,978 | 8/1934 | White | 431/266 |
| 2,318,408 | 5/1940 | Miess | 431/266 |
| 2,896,704 | 7/1959 | Aleweld | 431/266 |
| 2,960,980 | 11/1960 | Williams et al. | 431/266 |
| 3,362,455 | 1/1968 | Robertshaw | 431/78 |
| 3,454,346 | 7/1969 | Genbauffe | 431/266 |
| 3,490,434 | 1/1970 | Branson et al. | 431/266 |
| 3,490,435 | 1/1970 | Rice | 126/39 E |
| 3,730,672 | 5/1973 | Berlincourt et al. | 431/264 |
| 3,938,944 | 2/1976 | Riehl | 126/39 E |
| 4,035,136 | 7/1977 | Howatt et al. | 431/264 |
| 4,518,346 | 5/1985 | Pistien | 431/266 |
| 4,541,407 | 9/1985 | Sommers et al. | 126/39 E |
| 4,572,154 | 2/1986 | Schweitzer | 126/264 |
| 4,626,196 | 12/1986 | Stohrer, Jr. | 431/264 |
| 4,810,188 | 3/1989 | Kwiatek | 431/266 |

FOREIGN PATENT DOCUMENTS

| | | | |
|---|---|---|---|
| 2408096 | 7/1979 | France . | |
| 1175225 | 12/1969 | United Kingdom . | |
| 1450153 | 9/1976 | United Kingdom . | |
| 1543618 | 4/1979 | United Kingdom . | |
| 2020001 | 11/1979 | United Kingdom | 431/266 |

*Primary Examiner*—James C. Yeung
*Attorney, Agent, or Firm*—Mason, Kolehmaine, Rathburn & Wyss

[57] ABSTRACT

A spark electrode assembly for manual spark ignition of a gas burner and a method for manual spark ignition of a gas burner are provided. The spark electrode assembly includes an electrically conductive electrode contained within an electrically insulative support member. The electrically conductive electrode is positioned by the electrically insulative support member proximate to a predetermined portion of the gas burner. At least the predetermined portion of the gas burner is provided at ground potential. A high voltage potential is applied to the electrically conductive electrode responsive to a user's manual operation for spark ignition.

7 Claims, 1 Drawing Sheet

FIG. 1
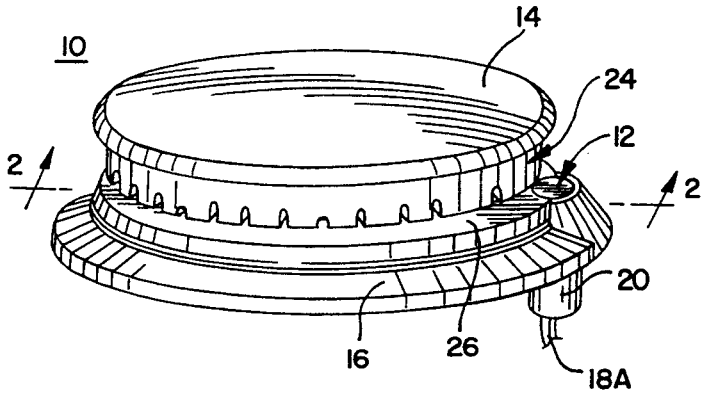
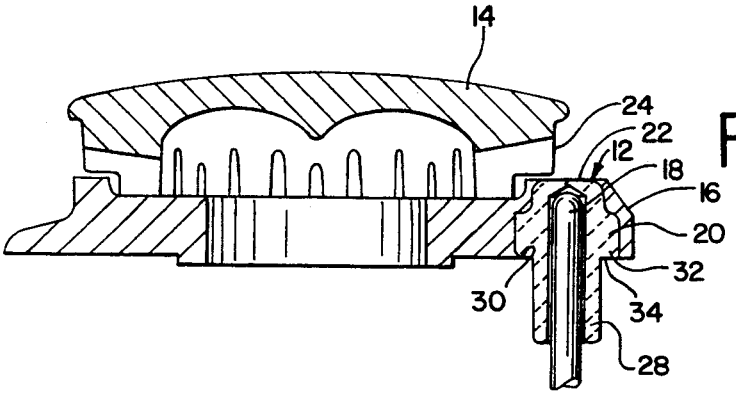
FIG. 2
FIG. 3
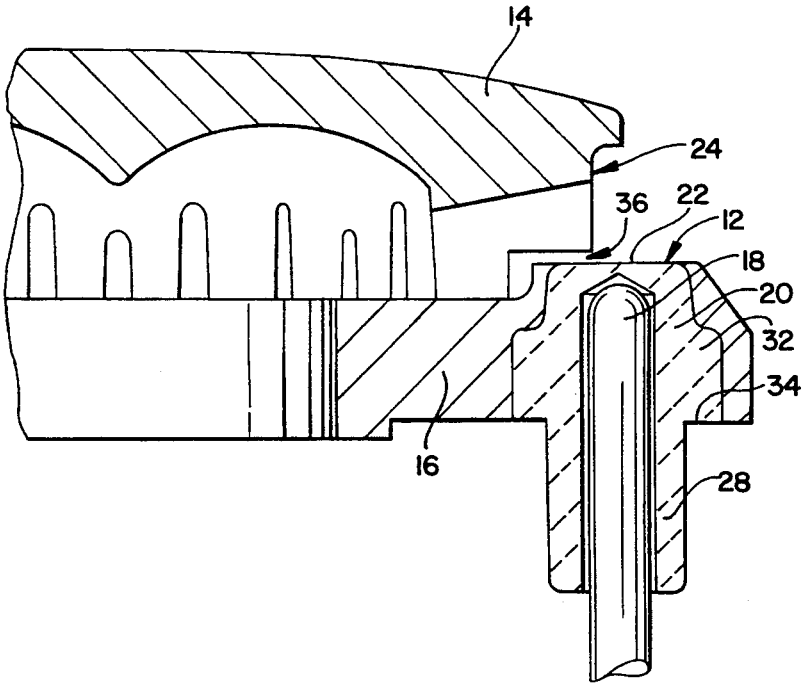

ELECTRODE ASSEMBLY FOR GAS BURNER SPARK IGNITION

RELATED APPLICATION

A related application having Ser. No. 08/153,228 and entitled "Gas Stove Top Burner Assembly" is being filed contemporaneously by the present inventor and has the same assignee as the present application.

BACKGROUND OF THE INVENTION

1. Field of the Invention

The present invention relates generally to spark ignition for gas appliances, and more particularly to an electrode assembly for manual spark ignition of a gas burner such as for a gas stove and a gas grill.

2. Description of the Prior Art

Various arrangements are known in the art for spark ignition of gas burners such as gas stove oven burners, gas stove top burners or gas barbecue grill burners. Many known arrangements include a high voltage electrode positioned relative to a ground member so that a spark will jump between the high voltage electrode and the ground member to ignite the gas when high voltage is applied to the high voltage electrode. Typically the high voltage electrode is positioned by an insulative support member so that an end portion of the electrically conductive wire defining the electrode is located near a grounded burner cap or side-wall. Problems with these arrangements include potential damage to the exposed end of the high voltage electrode during use and that reliable and repeatable operations may not be achieved due to the electrode position. Also, a possibility of electrical shock to the user exists.

U.S. Pat. Nos. 4,810,188 and 4,846,671 assigned to the assignee of the present invention, disclose improved spark ignited gas burner assemblies. While these spark ignited gas burner assemblies provide advantages over various known spark ignited burner assemblies, it is desirable to provide a spark ignition arrangement that eliminates the possibility of electrical shock to the user while providing reliable and repeatable operations.

SUMMARY OF THE INVENTION

Among the principal objects of the present invention are to provide an electrode for manual spark ignition of a gas burner; to provide a new and improved spark ignition electrode that provides effective and reliable operation; and to provide a spark ignition electrode overcoming many of the disadvantages of known spark ignition electrode arrangements.

In brief, the objects and advantages of the present invention are achieved by a spark electrode assembly for manual spark ignition of a gas burner and a method for manual spark ignition of a gas burner. The spark electrode assembly includes an electrically conductive electrode contained within an electrically insulative support member. The electrically conductive electrode is positioned by the electrically insulative support member proximate to a predetermined portion of the gas burner. At least the predetermined portion of the gas burner is provided at ground potential. A high voltage potential is applied to the electrode responsive to a user's manual operation for spark ignition.

BRIEF DESCRIPTION OF THE DRAWING

The present invention together with the above and other objects and advantages may best be understood from the following detailed description of the embodiment of the invention illustrated in the drawing, wherein:

FIG. 1 is a perspective view of a gas burner assembly including a spark electrode constructed in accordance with the principles of the present invention;

FIG. 2 is a cross-sectional view taken along the line 2—2 of FIG. 1; and FIG. 3 is an enlarged fragmentary, cross-sectional view of FIG. 2.

DETAILED DESCRIPTION OF THE PREFERRED EMBODIMENT

Referring now to the drawing, in FIGS. 1–3 there is illustrated a gas stove top burner assembly 10 including a spark electrode assembly generally designated by the reference character 12 and arranged in accordance with principles of the present invention. Having reference initially to FIG. 1, the burner assembly 10 includes a burner cap 14 and a burner base 16.

In accordance with the present invention, spark electrode assembly 12 eliminates many disadvantages of conventional spark ignition arrangements by having an electrically conductive spark electrode 18 contained within and positioned by an electrically insulative support member 20. An easily cleaned range configuration is enabled, while the likelihood of electrical shock to the user is eliminated.

A high voltage wire 18A connects the electrically conductive spark electrode 18 to a source of high voltage potential. Spark electrode 18 is an integral member formed of electrically conductive material, such as #310 stainless steel. The burner cap 14 and burner base 16 are provided at electrical ground potential. The burner cap 14 and burner base 16 are connected to an electrical ground potential with the gas stove top so that a separate ground connection and an insulative space member are not required.

A thin section 22 of the electrically insulative support member 20 is located between the spark electrode 18 and a portion generally designated 24 of the gas burner cap 14. Electrically insulative support member 20 is formed of a ceramic material, for example, such as cordierite, a self glaze material. Section 22 has a predetermined thickness that is selected to provide a cover for the electrode 18 while allowing a high voltage applied to the spark electrode to discharge through the ceramic material. Section 22 is disposed at the same level or flush with an upper surface 26 of the burner base 16 to provide an easily cleanable burner assembly 10. The ceramic section 22 is easily washable and conceals the high voltage spark electrode 18 to eliminate the possibility of electrical shock to the user while providing reliable and repeatable operations.

Electrically insulative support member 20 includes a lower body portion 28 that is slideably received through an aperture 30 in the gas burner base 16. An upper body portion 32 of support member 20 engages a stop 34 defined by the gas burner base 16 to position the thin section 22 flush with the upper base surface 26.

The advantages of the present invention are not limited to any particular burner cap 14 and burner base 16. Burner cap 14 and burner base 16 can be thick wall members or stamped and formed thin wall members, such as of a #3003 aluminum alloy.

A user's manual operation for spark ignition provides a high voltage potential to the spark electrode 18 of the spark electrode assembly 12. The high voltage potential causes sparks to be produced at a spark gap generally designated at 36, or through the gasway, for providing reliable and repeatable spark ignition operations.

While the invention has been described with reference to details of the illustrated embodiment, these details are not intended to limit the scope of the invention as defined in the appended claims.

What is claimed and desired to be secured by Letters Patent is:

1. A method for manual spark ignition of a gas burner comprising the steps of:

providing at least a portion of the gas burner at ground potential;

providing an electrically conductive electrode contained within and positioned by an electrically insulative support member proximate to said gas burner portion; including the step of:

providing said electrically insulative support member with a predetermined wall thickness proximate to said gas burner portion; and applying a high voltage potential to said electrically conductive electrode responsive to a user's manual operation.

2. An electrode assembly for manual spark ignition of a gas burner comprising:

an electrically conductive electrode;

an electrically insulative support member for enclosing and positioning said electrically conductive electrode proximate to the gas burner; said electrically insulative support member includes a thin section located between the spark electrode and a portion of the gas burner; and means responsive to a user's manual operation for applying a high voltage potential to said electrically conductive electrode.

3. An electrode assembly as recited in claim 2 wherein said electrically conductive electrode is an integral member formed of stainless steel.

4. An electrode assembly as recited in claim 2 wherein said thin section of said electrically insulative support member has a predetermined thickness for allowing a high voltage applied to the spark electrode to discharge through the thin section.

5. An electrode assembly as recited in claim 2 wherein electrically insulative support member is formed of a ceramic material.

6. An electrode assembly as recited in claim 5 wherein said ceramic material is a cordierite self glaze material.

7. An electrode assembly as recited in claim 2 wherein an upper surface of said electrically insulative support member is flush with a burner base upper surface.

* * * * *